United States Patent [19]

Becka

[11] 4,224,708

[45] Sep. 30, 1980

[54] UPPER MOLDING AND FLANGING MACHINE

[75] Inventor: Michael M. Becka, Nashua, N.H.

[73] Assignee: International Shoe Machine Corporation, Nashua, N.H.

[21] Appl. No.: 5,934

[22] Filed: Jan. 24, 1979

[51] Int. Cl.[2] ..... A43D 21/00; A43D 95/00

[52] U.S. Cl. ..... 12/8.2; 12/54.3; 12/54.4

[58] Field of Search ..... 12/8.2, 12, 12.3, 12.4, 12/12.5, 14.4, 54.1, 54.3, 54.4, 54.6

[56] References Cited

U.S. PATENT DOCUMENTS

| | | | |
|---|---|---|---|
| 3,051,969 | 9/1962 | Kamborian et al. | 12/8.2 |
| 3,245,100 | 4/1966 | Choice et al. | 12/54.3 |
| 3,328,815 | 7/1967 | Forma | 12/54.3 |

*Primary Examiner*—Patrick D. Lawson
*Attorney, Agent, or Firm*—Albert Gordon

[57] ABSTRACT

A machine that molds an upper to the shape of a male mold by a female mold and that flanges the margin of the upper by a pair of wipers mounted to the female mold. The wipers have bases hinged to each other for swinging movement about a vertex and legs extending forwardly and divergently of the bases, the wiper bases being mounted to a back part of the female mold and the wiper legs being mounted to side parts of the female mold. The wiper bases are so constructed as to be movable forwardly of the back part and the wiper legs are so constructed as to be movable inwardly of the side parts pursuant to the forward movement of the wiper bases relative to the back part.

2 Claims, 7 Drawing Figures

UPPER MOLDING AND FLANGING MACHINE

BACKGROUND OF THE INVENTION

U.S. patent application Ser. No. 890,747, filed Mar. 27, 1978, discloses a machine for molding an upper to the shape of a male mold and forming a flange on the margin of the molded upper. This prior machine comprises: the male mold; a female mold mounted for forward-rearward movement towards and away from the male mold, the female mold having a back part and side parts extending forwardly of the back part and mounted for inward-outward movement with respect to the back part; a pair of wipers having bases hinged to each other for swinging movement about a vertex and legs extending forwardly and divergently of the bases, the wiper bases being mounted to the back part and the wiper legs being mounted to the side parts; means for initially maintaining the female mold in a rearward position spaced from the male mold with the side parts and the wiper legs in outer positions; and means for thereafter imparting forward translatory movement to the female mold to cause the back part to press the back end of the upper mounted on the male mold against the back end of the male mold, the pressing of the back end of the upper against the back end of the male mold terminating the forward translatory movement of the female mold, and for then causing the side parts to move inwardly and press side portions of the upper against the sides of the male mold. In the prior machine, the wiper legs are so mounted to the side parts as to impart swinging movement of the wiper legs about the vertex inwardly of the side parts to thereby cause the wiper legs to engage the margin of the upper and wipe or fold the upper margin against the bottom of the male mold to thereby form a flange on the molded upper.

SUMMARY OF THE INVENTION

It has been found that the flanging operation of the prior machine would be improved if the vertex of the wipers were advanced forwardly of the back part and if the wiper legs were swung further inwardly of the side parts than is accomplished in the prior machine so that the wiping motion of the wipers relative to the male mold would be similar to that shown in U.S. Pat. No. 3,007,182. It is the object of this invention to modify the machine of U.S. patent application Ser. No. 890,747 so as to achieve the wiping action referred to in the preceding sentence while still mounting the wipers on the female mold as in U.S. patent application Ser. No. 890,747, so as to avoid having separate mounting arrangements for the female mold and the wipers and so as to enable a single driving mechanism to operate the female mold and the wipers. This object is accomplished by mounting the wiper bases to the back part for forward-rearward movement, by initially retaining the wiper bases in a rearward position relative to the back part, and by providing means effective after the termination of the forward translatory movement of the female mold for moving the wiper bases forwardly with respect to the back part, the mounting of the wiper legs to the side parts being so constructed and arranged as to cause inward movement of the wiper legs about the vertex in response to the forward movement of the wiper bases.

DESCRIPTION OF THE PREFERRED EMBODIMENT

Figure 1:
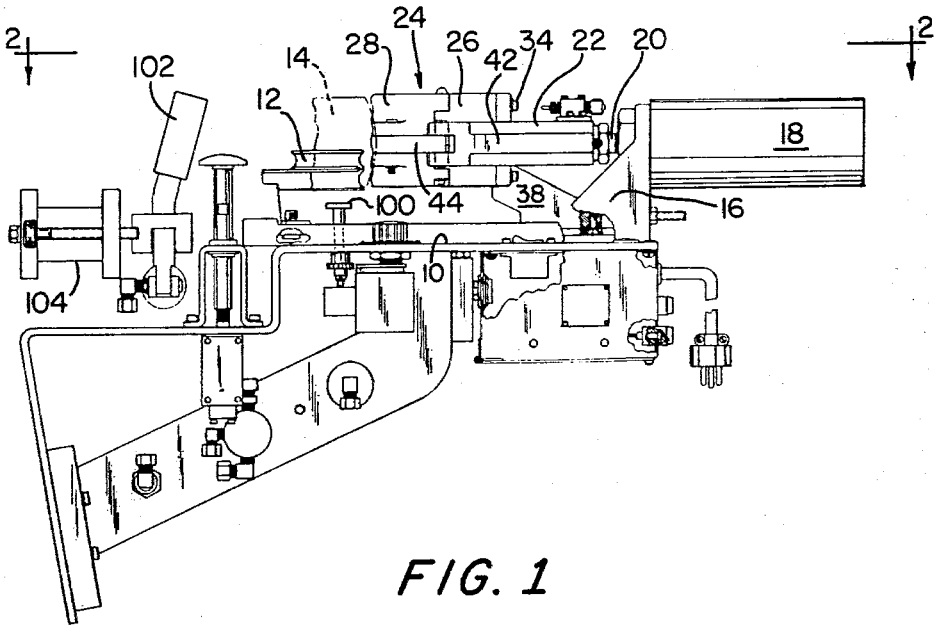
FIG. 1 is a side elevation of the machine.

Although, in actuality, the machine as depicted in FIG. 1 is mounted close to the vertical with the parts at the right end of FIG. 1 being the uppermost parts of the machine and the parts at the left end of FIG. 1 being the lowermost parts of the machine, for convenience of description the machine will be considered to be mounted horizontally as shown in FIG. 1. As seen in FIG. 1, the left ends of machine parts will be considered to be their fronts and the right ends of machine parts will be considered to be their backs. Also as seen in FIG. 1, right to left movements and directions will be considered to be "forward" and left to right movements and directions will be considered to be "rearward".

Figure 2:
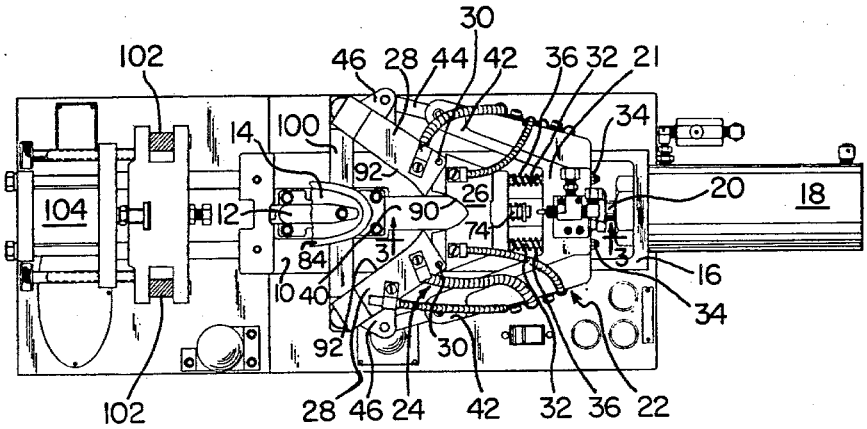
FIG. 2 is a plan view of the machine taken on the line 2—2 of FIG. 1.
Figure 3:
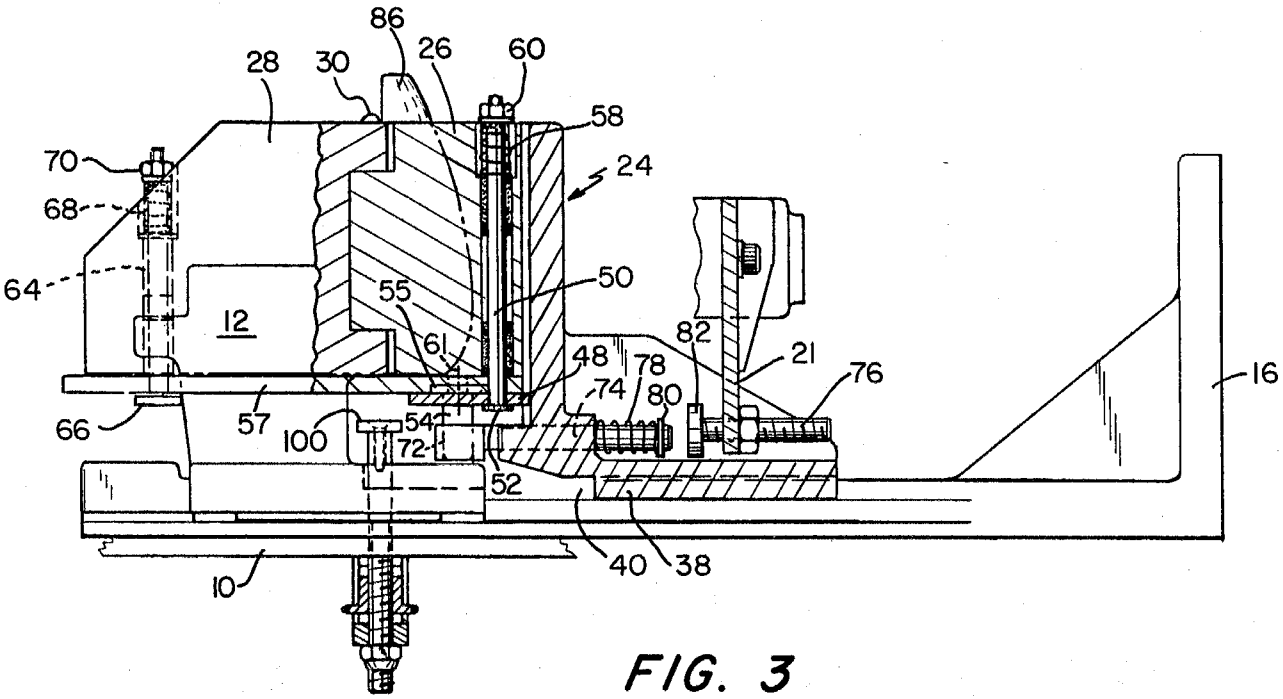
FIG. 3 is a section taken along the line 3—3 of FIG. 2.

Referring to FIGS. 1-3, the machine includes a base 10 having a mount 12 upstanding therefrom. A male mold 14 is secured to the mount 12. A bracket 16, mounted to the base 10, has a pneumatic motor 18 secured thereto. The piston rod 20 of the motor 18 is secured to the base 21 of a yoke 22. A female mold 24 is mounted to and extends forwardly of the yoke 22. The mold 24 comprises a back part 26 and a pair of side parts 28. The side parts 28 are pivoted to opposite sides of the front of the back part 26 by pivot pins 30 and extend forwardly and divergently from the back part.

A plurality of bolts 32 are mounted to the back part 26 and extend rearwardly thereof through holes in the yoke 22. A nut 34 is threaded onto each bolt 32, each nut 34 being located rearwardly of the yoke 22. A compression spring 36 is entwined about each bolt 32 between the back part 26 and the yoke base 21 to thereby yieldably urge the back part 26 forwardly of the yoke 22 to an extent determined by the engagement of the nuts 34 with the back of the yoke base 21. The back part 26 is slidably mounted to the base 10 for forward-rearward movement by being secured to a slide 38 that is slidably mounted in a forwardly-rearwardly extending slot 40 in the base 10.

The yoke 22 has forwardly and divergently extending arms 42. A link 44 is pivoted to and extends forwardly of the front of each arm 42 and the front of each link 44 is pivoted to a pair of lugs 46 that are each secured to a side part 28.

Figure 4:
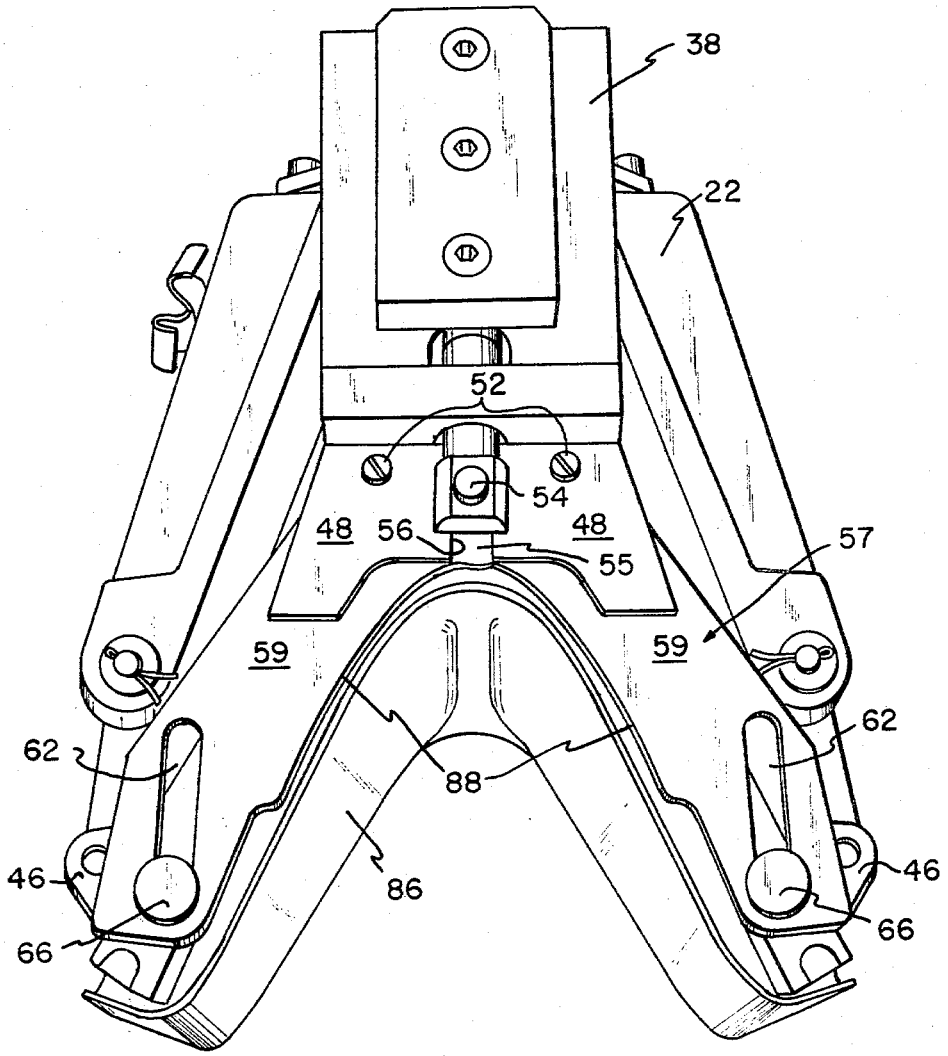
FIG. 4 is an isometric view of the bottom of the female mold with the wipers mounted thereto.

Referring to FIGS. 3 and 4, a retainer 48 is mounted to the bottom of the back part 26 by a pair of bolts 50 that extend through openings in the retainer 48 and the back part 26 with the heads 52 of the bolts 50 bearing against the bottom of the retainer 48. A pin 54 is movable in forward-rearward directions in a slot 56 in the retainer 48. The top of the pin 54 is connected to bases 55 of a pair of wipers 57. The wipers 57 have legs 59 that extend forwardly and divergently of the bases 55 beneath the side parts 28 and are pivotable about the axis of a vertex 61 in the bases 55 that lies on the axis of the pin 54. Compression springs 58 in the back part 26 bear against nuts 60 mounted to the tops of the bolts 50 to yieldably force the retainer 48 upwardly and thereby yieldably urge the wiper bases 55 against the bottom of the back part 26. A forwardly-rearwardly extending slot 62 extends through the front end of each wiper leg 59. A bolt 64 extends through each slot 62 and through the associated side part 28 with the head 66 of each bolt 64 bearing against the bottom of its associated wiper leg 59. A compression spring 68 in each side part 28 bears against a nut 70 mounted to the top of each bolt 64 to yieldably force the bolt heads 66 upwardly and thereby yieldably urge the forward ends of the wiper legs 59 against the side parts 28.

Referring to FIGS. 2 and 3, the bottom of the pin 54 is received in an opening 72 at the front of a rod 74 that is slidably mounted for forward-rearward movement in the back part 26. A stud 76 is mounted to the yoke base 21 rearwardly of and in alignment with the rod 74. A compression spring 78 is entwined about the rod 74 between the back of the back part 26 and a washer 80 mounted to the back of the rod 74, the spring 78 acting to yieldably urge the bar 74 rearwardly towards a head 82 at the front of the stud 76.

A liner 84 of a flexible material such as Teflon may be secured to the periphery of the male mold 14 (See FIG. 2) and a similar liner 86 (See FIG. 4) may extend along the inner peripheries of the back part 26 and the side parts 28 of the female mold 24.

In the idle condition of the machine: The piston rod 20 is retracted into the motor 18 to thereby retain the yoke 22 in a rearward position with the springs 36 pushing the female mold back part 26 forwardly of the yoke base 21 to a position wherein the nuts 34 engage the back of the yoke base 21. In this position, the links 44 maintain the female mold side parts 28 relatively far from each other and from the sides of the male mold 14, the connection formed by the slots 62 and the bolts 64 maintain the wiper legs 59 swung about the vertex 61 relatively far from each other with bolts 64 at the front ends of the slots 62, and the back of the rod 74 is spaced forwardly of the head 82, the spring 78 urging the pin 54 to the back of the slot 56 to retain the wipers 57 in a relatively rearward position. As a result, as seen in FIGS. 2 and 4, the wipers 57 are located so that their inwardly facing edges 88 are located close to the inwardly facing edge 90 of the back part 26 and the inwardly facing edges 92 of the side parts 28 of the female mold 24.

Figure 5:
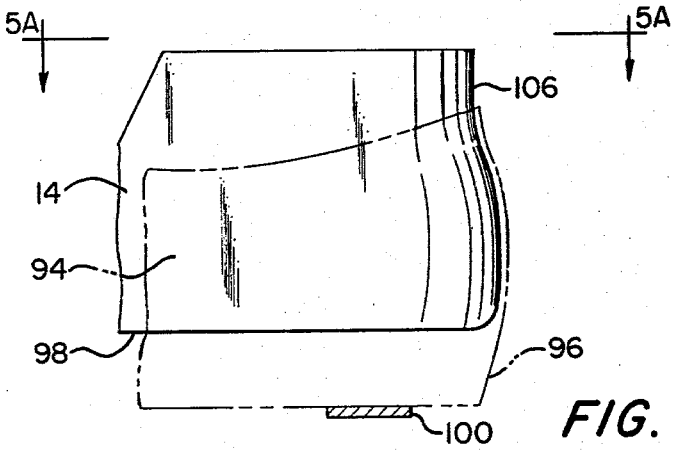
FIG. 5 is a schematic representation of the male mold having the upper draped thereon.
Figure 5A:
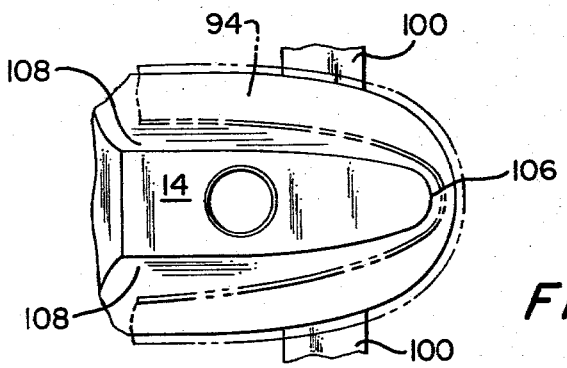
FIG. 5A is a view taken along the line 5A—5A of FIG. 5.

Referring to FIGS. 5 and 5A, the quarter of an upper 94 is draped about the male mold 14 with the margin 96 of the upper extending downwardly of the bottom 98 of the male mold 14 and resting on a gauge plate 100. The gauge plate 100, as shown in FIGS. 1 and 2, is mounted to the base 10. The forepart portions of the upper are gripped by pincers 102 and the pincers 102 are yieldably moved forwardly by a pneumatic motor 104 (See FIG. 1 and 2) to force the heel end extremity of the upper 94 against the back end 106 of the male mold 14.

Now the motor 18 is actuated to move its piston rod 20 yieldably forwardly under the force of pressurized air to thereby translate the yoke 22 and the female mold 24 forwardly. This forward translatory movement of the female mold continues until the forward movement of the back part 26 is arrested by the heel end 106 of the male mold 14 with the heel end of the upper 94 interposed between the male mold 14 and the female mold back part 26. Continued forward movement of the yoke 22 causes the yoke 22 to move forwardly of the now stationary bolts 32, causes the springs 36 to be compressed, and causes the links 44 to swing the female mold side parts 28 inwardly about the axes of the pins 30 until the side parts 28 press the side portions of the upper 94 against the sides 108 of the male mold 14. Pursuant to the inward movement of the side parts 28, due to the connection formed by the slots 62 and the bolts 66 between the side parts 28 and the wiper legs 59, the wiper legs 59 are caused to move inwardly of the side parts 28 about the vertex 61. When the inward movements of the side parts 28 are completed, the slots 62 slope forwardly and inwardly. The yoke 22 stops its forward movement when the side parts 28 can no longer move inwardly due to resistance to such inward movement by the male mold 14.

The continued forward movement of the yoke 22, after the forward movement of the back part 26 has been arrested by the heel end 106 of the male mold 14, causes the stud head 82 to approach and engage the back of the rod 74 and then move the rod 74 forwardly with respect to the now stationary back part 26 to thereby cause the pin 54 to move forwardly in the slot 56. This forward movement of the pin 54 in the slot 56 enables the wipers 57 to move forwardly with respect to the female mold 24 with the vertex moving forwardly of the back part 26. During this forward movement of the wipers 57 with respect to the female mold 24, the bolts 64 have such relative movement with respect to the slots 62 that they are displaced rearwardly along the slots 62. Due to the forward and inward slope of the slots 62 of this time, the rearward displacement of the bolts 64 along the slots 62 causes the wipers 57 to swing further inwardly about the axis of the wipers vertex 61 while the wipers vertex is moving forwardly. The inward movement of the wiper legs 59 pursuant to the inward movement of the side parts 28 and the concomitant forward and inward movement of the wipers 57 pursuant to the forward movement of the pin 54 in the slot 56 causes the wiper bases 55 to move forwardly of the back part edge 90 and the wipers edges 88 to move inwardly of the side parts edges 92 to thereby cause the wipers 57 to engage the upper margin 96 and wipe or fold the upper margin against the bottom 98 of the male mold 14. During this inwiping movement of the wipers 57, the springs 58, 68 enable the wipers to yieldably move downwardly of the male mold 14, should this downward movement be necessary, in order for the wipers 57 to be able to move beneath the male mold bottom 98 during their wiping movements.

Figure 6:
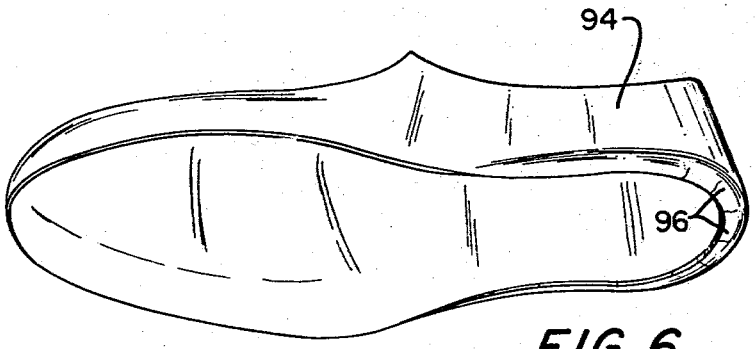
FIG. 6 is an isometric view of the upper with the flange thereon as it appears after the upper has been operated on by the machine of this invention.

As is conventional, the upper quarter has a thermoplastic counter that is rigid at ambinet temperatures incorporated therein, and the male mold 14 and/or the female mold 24 have electric cartridge heaters incorporated therein. The heat from the electric cartridge heaters softens the upper and the counter to the shape of the male mold 14 during the molding operation that takes place during the pressing of the upper quarter by the female mold 24 against the male mold 14. When the upper is removed from the machine pursuant to the return of the machine parts to their idle conditions, the counter reverts to its rigid condition and the upper quarter retains the shape imparted to it during the molding operation with the quarter of the upper margin 96 being formed into an inwardly directed flange by the flanging operation that takes place during the aforementioned inwiping movement of the wipers 57. FIG. 6 illustrates the upper 94 having the flanged margin 96 at its quarter after the upper has been removed from the machine.

After removal from the machine of this invention, the upper 94 is mounted on a last having an insole secured to its bottom. The shoe assembly, formed of the last, the upper, and the insole, is then presented to a toe pulling over and lasting machine of the type shown in U.S. Pat. No. 3,902,211 for a pulling over and toe lasting operation. The flanged upper margin 96 at the quarter of the upper facilitates the proper placement of the upper on the last and minimizes the manual manipulation of the upper on the last by the operator during the operation of the pulling over and toe lasting machine.

There follows a recapitulation of the description of those portions of the machine and its mode of operation that are germane to this invention.

The machine comprises the following features that are disclosed in U.S. patent application Ser. No. 890,747: the male mold 14; the female mold 24 mounted for forward-rearward movement toward and away from the male mold 14, the female mold having the back part 26 and the side parts 28 extending forwardly of the back part 26 and mounted for inward-outward movement with respect to the back part 26; the pair of wipers 57 having the bases 55 hinged to each other for swinging movement about the vertex 61 and the legs 59 extending forwardly and divergently of the bases 55, the wiper bases 55 being mounted to the back part 26 and the wiper legs 59 being mounted to the side parts 28; means comprised of the motor 18 and the appropriate pneumatic circuitry therefor (not shown) for initially maintaining the female mold 24 in a rearward position spaced from the male mold 14 with the side parts 28 and the wiper legs 59 in outer positions; and means comprised of the motor 18 and the appropriate pneumatic circuitry therefor (not shown) for thereafter imparting forward translatory movement to the female mold 24 to cause the back part 26 to press the back end of the upper 94 mounted on the male mold 14 against the back end 106 of the male mold 14, said pressing of the back end of the upper 94 against the back end of the male mold 14 terminating said forward translatory movement, and for then causing the side parts 28 to move inwardly and press side portions of the upper 94 against the sides 108 of the male mold 14.

The machine described in the preceding paragraph is improved, in accordance with this invention, by comprising; means, formed by the pin 54, the retainer 48 and the slot 56, mounting the wiper bases 55 to the back part 26 for forward-rearward movement; means for initially retaining the wiper bases 55 in a rearward position relative to the back part 26; and means effective after the termination of the forward translatory movement of the female mold 24 for moving the wiper bases 55 forwardly with respect to the back part 26, the mounting of the wiper legs 59 to the side parts by the slots 62 and the bolts 64 being so constructed and arranged as to cause inward movement of the wiper legs 59 about the vertex 61 in response to the forward movement of the wiper bases 55.

The machine also comprises the following features that are disclosed in U.S. patent application Ser. No. 890,747: The yoke 22 having the base 21 located rearwardly of the female mold 24, the yoke 22 being mounted for forward-rearward movement; and a yieldable connection formed by the bolts 32, the nuts 34 and the springs 36 so connecting the yoke base 21 to the back part 26 as to yieldably urge the back part 26 forwardly of the yoke base 21. In this machine, as in the disclosure of U.S. patent application Ser. No. 890,747, the motor 18 and the appropriate pneumatic circuitry therefor (not shown) that initially maintain the female mold 24 in its rearward position does this by initially maintaining the yoke 22 in a rearward position; the means formed by the motor 18 and the appropriate pneumatic circuitry therefor (not shown) that imparts forward translatory movement to the female mold 24 and then causes the side parts 28 to move inwardly does this by imparting forward movement to the yoke 22 with the yieldable connection 32, 34, 36 enabling the female mold 24 to effect forward translatory movement in unison with the forward movement of the yoke 22 until the forward translatory movement of the female mold 24 is terminated as aforesaid after which the yoke 22 advances relative to the back part 26 against the force of the yieldable connection 32, 34, 36, the yoke 22 being so connected to the side parts 28 by the links 44 as to impart said inward movements to the side parts 28 pursuant to the advancement of the yoke 22 relative to the back part 26; and the wiper bases 55 are mounted to the back part 26 by the pin 54 whose axis coincides with the vertex 61.

The machine described in the preceding paragraph is improved, in accordance with this invention in that the means for initially retaining the wiper bases 55 in their rearward position relative to the back part 26 comprises the rod 74, connected to the pin 54, extending through and movable forwardly-rearwardly with respect to the back part 26, and spring means formed by the spring 78 yieldably urging the rod 74 rearwardly with respect to the back part 26; and in that the means for moving the wiper bases 55 forwardly with respect to the back part 26 comprises the head 82 mounted to the yoke base 21 in alignment with the rod 74 and operative to move the rod 74 forwardly relative to the back part 26 pursuant to the advancement of the yoke 22 relative to the back part 26.

Instead of heating the upper quarter and the counter while they are interposed between the male mold 14 and the female mold 24, as described above, the upper quarter and the counter may be heated and softened prior to insertion in the machine of this invention. In this event, the male mold 14 is cooled, preferably to a temperature below 32° F., to quickly rigidify the upper quarter and the counter subsequent to the molding and flanging operation.

I claim:

1. An upper molding and flanging machine comprising: a male mold; a female mold mounted for forward-rearward movement towards and away from the male mold, the female mold having a back part and side parts extending forwardly of the back part and mounted for inward-outward movement with respect to the back part; a pair of wipers having bases hinged to each other for swinging movement about a vertex and legs extending and divergently of the bases, the wiper bases being mounted to the back part and the wiper legs being mounted to the side parts; means for initially maintaining the female mold in a rearward position spaced from the male mold with the side parts and the wiper legs in outer positions; and means for thereafter imparting forward translatory movement to the female mold to cause the back part to press the back end of an upper mounted on the male mold against the back end of the male mold, said pressing of the back end of the upper against the back end of the male mold terminating said forward translatory movement, and for then causing the side parts to move inwardly and press side portions of the upper against the sides of the male mold; characterized in that the machine comprises: means mounting the wiper bases to the back part for forward-rearward movement; means for initially retaining the wiper bases in a rearward position relative to the back part; and means effective after the termination of the forward translatory movement of the female mold for moving the wiper bases forwardly with respect to the back part, the mounting of the wiper legs to the side parts being so constructed and arranged as to cause inward movement of the wiper legs about the vertex in response to said forward movement of the wiper bases.

2. The machine of claim 1 further comprising: a yoke having a base lcoated rearwardly of the female mold, the yoke being mounted for forward-rearward movement; and a yieldable connection so connecting the yoke base to the back part as to yieldably urge the back part forwardly of the yoke base; wherein said means for initially maintaining the female mold in its rearward position comprises means for initially maintaining the yoke in a rearward position; and wherein the means for imparting forward translatory movement to the female mold and then causing the side parts to move inwardly comprises; means for imparting forward movement to the yoke with the yieldable connection enabling the female mold to effect forward translatory movement in unison with the forward movement of the yoke until the forward translatory movement of the female mold is terminated as aforesaid after which the yoke advances relative to the back part against the force of the yieldable connection, the yoke being so connected to the side parts as to impart side inward movements to the side parts pursuant to the advancement of the yoke relative to the back part; and wherein the wiper bases are mounted to the back part by a pin whose axis coincides with said vertex; characterized in that the means for initially retaining the wiper bases in said rearward position relative to the back part comprises a rod, connected to the pin, extending through and movable forwardly-rearwardly with respect to the back part, and spring means yieldably urging the rod rearwardly with respect to the back part; and characterized in that said means for moving the wiper bases forwardly with respect to the back part comprises a head mounted to the yoke base in alignment with the rod and operative to move the rod forwardly relative to the back part pursuant to the advancement of the yoke relative to the back part.

* * * * *